US006367919B1

(12) United States Patent
Taylor et al.

(10) Patent No.: US 6,367,919 B1
(45) Date of Patent: Apr. 9, 2002

(54) INK CONTAINER WITH INK LEVEL GAUGE

(75) Inventors: Bret Taylor, Vancouver; Jefferson P. Ward, Brush Prairie, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/615,155

(22) Filed: Jul. 13, 2000

(51) Int. Cl.[7] ..... B41J 2/175; B41J 2/195
(52) U.S. Cl. ..... 347/86; 347/7
(58) Field of Search ..... 347/86, 87, 7, 347/85; 116/276; 222/155, 158, 159

(56) References Cited

U.S. PATENT DOCUMENTS

| | | | | |
|---|---|---|---|---|
| 2,190,027 A | | 2/1940 | Jordan | |
| 3,448,616 A | | 6/1969 | Wostl et al. | |
| 4,038,650 A | | 7/1977 | Evans et al. | |
| 4,443,699 A | | 4/1984 | Keller | |
| 4,544,840 A | | 10/1985 | Keller | |
| 4,938,590 A | | 7/1990 | Ishida | |
| 4,969,759 A | * | 11/1990 | Suzuki et al. | 100/124.1 |
| 4,973,993 A | | 11/1990 | Allen | |
| 5,054,319 A | | 10/1991 | Fling | |
| 5,079,570 A | | 1/1992 | Mohr et al. | |
| 5,329,304 A | * | 7/1994 | Koimumi et al. | 347/7 |
| 5,453,771 A | * | 9/1995 | Waseda et al. | 347/86 |
| 5,616,929 A | | 4/1997 | Hara | |
| 5,652,610 A | * | 7/1997 | Kawai et al. | 347/87 |
| 5,742,312 A | * | 4/1998 | Carlotta | 347/87 |

FOREIGN PATENT DOCUMENTS

JP 10-100433 A * 4/1998 ..... B41J/2/175

* cited by examiner

*Primary Examiner*—Judy Nguyen

(57) ABSTRACT

An ink container for an inkjet printer includes a body having a first ink chamber. The body also has a second ink chamber, with a fluid passage connecting the chambers. The second ink chamber has an elongated capillary portion with a light transmissive window revealing the presence of ink in the capillary portion. The first ink chamber is the primary ink storage chamber, and contains an ink-retaining foam element that contacts a capillary feature of the passage. The foam is compressed at one portion to provide a capillarity gradient, and the second chamber capillary has a capillary gradient.

7 Claims, 5 Drawing Sheets

INK CONTAINER WITH INK LEVEL GAUGE

FIELD OF THE INVENTION

This invention relates to ink jet printing, and more particularly to ink jet ink containment and provision of ink level determination.

BACKGROUND AND SUMMARY OF THE INVENTION

In ink jet printers, ink jet print cartridges or "pens" are reciprocated on a carriage to print swaths on an advancing media sheet. Pens typically include an ink chamber filled primarily with ink, with a print head having an array of nozzles for expelling ink droplets in a controlled pattern. Many existing pens are self contained units that are discarded when ink is depleted, however, the ink chamber can be constructed as an independent container that is removable from the print head. As ink is consumed, it is desirable for the user to know the amount of ink remaining in the cartridge. This allows new pens to be purchased adequately in advance, and permits replacement of nearly depleted pens or ink containers to be made before initiating large print jobs, or before allowing an ink jet facsimile machine to be unattended for an extended period.

Existing ink jet printing systems employ various approaches to provide ink level information to the user or to the printer control circuitry. One technique employs a "drop counting" circuitry that counts the number of ink droplets printed, and uses this to estimate the total quantity of ink consumed. While this is an adequate estimate for some purposes, it does not provide a reliably absolute measurement, since drop volumes are generally not precisely controlled. In addition, the technique requires electronic resources to be dedicated to the ongoing calculation, increasing printer and pen cost and complexity.

Other techniques have sought to estimate pen ink levels with electronic sensing of the thermal capacitance of the ink mass by heating a semiconductor chip adjacent the ink, and measuring the rate of conduction or cool-down, which varies with the ink quantity. This is a complex and inaccurate technique, as is the technique of measuring electrical resistance across the ink mass.

Visual fluid gauges have long been employed in simple fluid containers having a "window" for viewing the fluid level in an otherwise opaque container. However, most ink jet devices contain pressure regulation systems in the container which make it difficult to see the ink and establish an ink level. More particularly, in ink jet pens employing capillary foam for retaining the ink with a negative head to avoid ink "drool" from the nozzles, the ink-carrying foam does not provide visual evidence of its saturation level. An "empty" pen will appear much the same as an "full" pen, because the foam in the empty pen contains significant residual ink. And even if there were a slight appearance change between "full" and "empty," this would not be reflected in a discernible "level" that indicated at any given moment the pen fill status; the entire foam would appear substantially uniform under all circumstances.

The present invention overcomes the limitations of the prior art by providing an ink jet print cartridge with a body having a first ink chamber. The body also has a second ink chamber, with a fluid passage connecting the chambers. The second ink chamber has an elongated capillary portion with a light transmissive window revealing the presence of ink in the capillary portion. The first ink chamber may be the primary ink storage chamber, and may contain an ink-retaining foam element that contacts a capillary feature of the passage. The foam may be compressed at one portion to provide a capillarity gradient, and the second chamber capillary may also have a capillary gradient.

DETAILED DESCRIPTION OF A PREFERRED EMBODIMENT

Figure 1A:
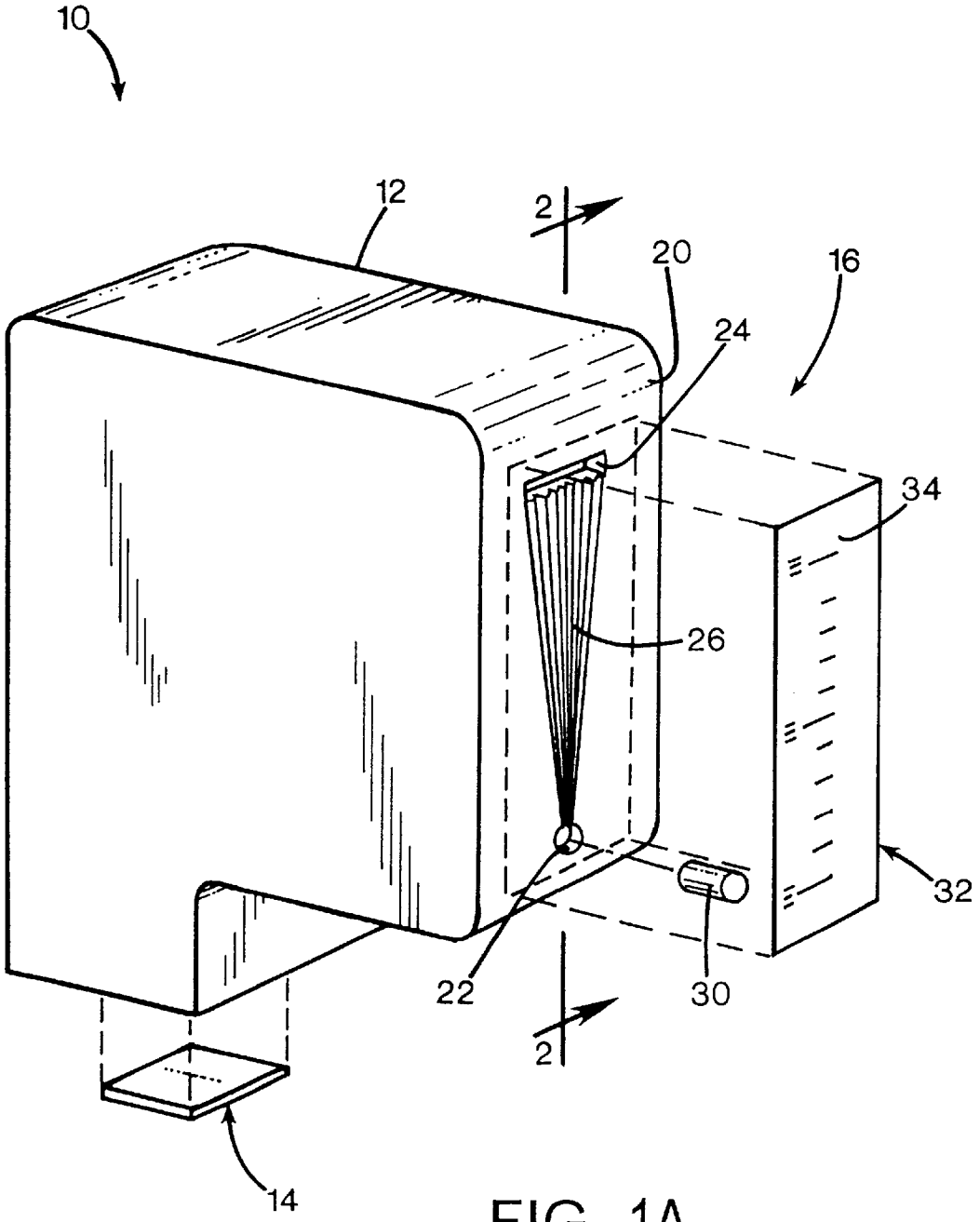
FIG. 1A is an exploded perspective view of an ink jet printer pen according to a preferred embodiment of the invention.

FIG. 1A shows a ink jet pen 10 having a housing 12. An ink jet print head 14 is attached to a lower face of the housing, which is largely hollow to provide an ink chamber as will be discussed below. Ink in the chamber flows to the print head, which is electrically connected to a printer. The printer energizes elements in the print head (preferrably, resistive heating elements, but other electromechanical or electrostatic elements may also effectively be used) to expel droplets of ink through nozzles on the lower surface of the print head onto print media below the pen.

A capillary action manometer 16 is a second ink chamber connected to the main chamber, and is provided on a flat major vertical face 20 of the pen on a side readily visible to a user. In an alternative embodiment, the manometer and capillary features need not be vertical, as the forces acting on the fluid operate irrespective of gravity. The manometer includes a first passage 22 extending into the interior of the housing through a lower portion of the face 20. A second passage 24 at an upper end of the face 20 also communicates with the housing interior. A series of parallel or radial grooves 26 is defined in the face 20, each groove extending from the lower passage 22 to the upper passage. The grooves are preferably molded into the housing material, with sharp V-shaped profiles to facilitate ink wicking or capillary action, thereby distributing ink within the manometer. Each groove is narrowest near the lower passage, and widest near the upper passage.

In an alternative embodiment, the upper end of the manometer may communicate with the exterior of the housing, allowing suction to be applied to fill the manometer with fluid upon manufacturing. Such priming action may be necessary for embodiments in which ink initially does not fill the manometer due to the tendency of some fluids to have significantly less affinity for dry passages than for wetted passages.

A wicking plug 30 resides in the lower passage 22, with one end extending into the housing interior, and the other being flush with the surface of face 20, as will be discussed below. The plug is preferably formed of a material having small passages, such as a rigid plastic or metal sintered material, an open cell foam, or a solid element defining numerous narrow bores or grooves. Alternatively, the passage itself may be a small diameter bore adequate to provide wicking. A self adhesive transparent plastic sheet 32 is affixed over the entire manometer and both passages to enclose the manometer "tubes" and to provide a peripheral seal about the manometer chamber to prevent leakage and contamination. Printed indicia 34 are provided on the sheet to indicate the fractional quantity of ink remaining, given the level to which ink wicks up the grooves.

Figure 1B:
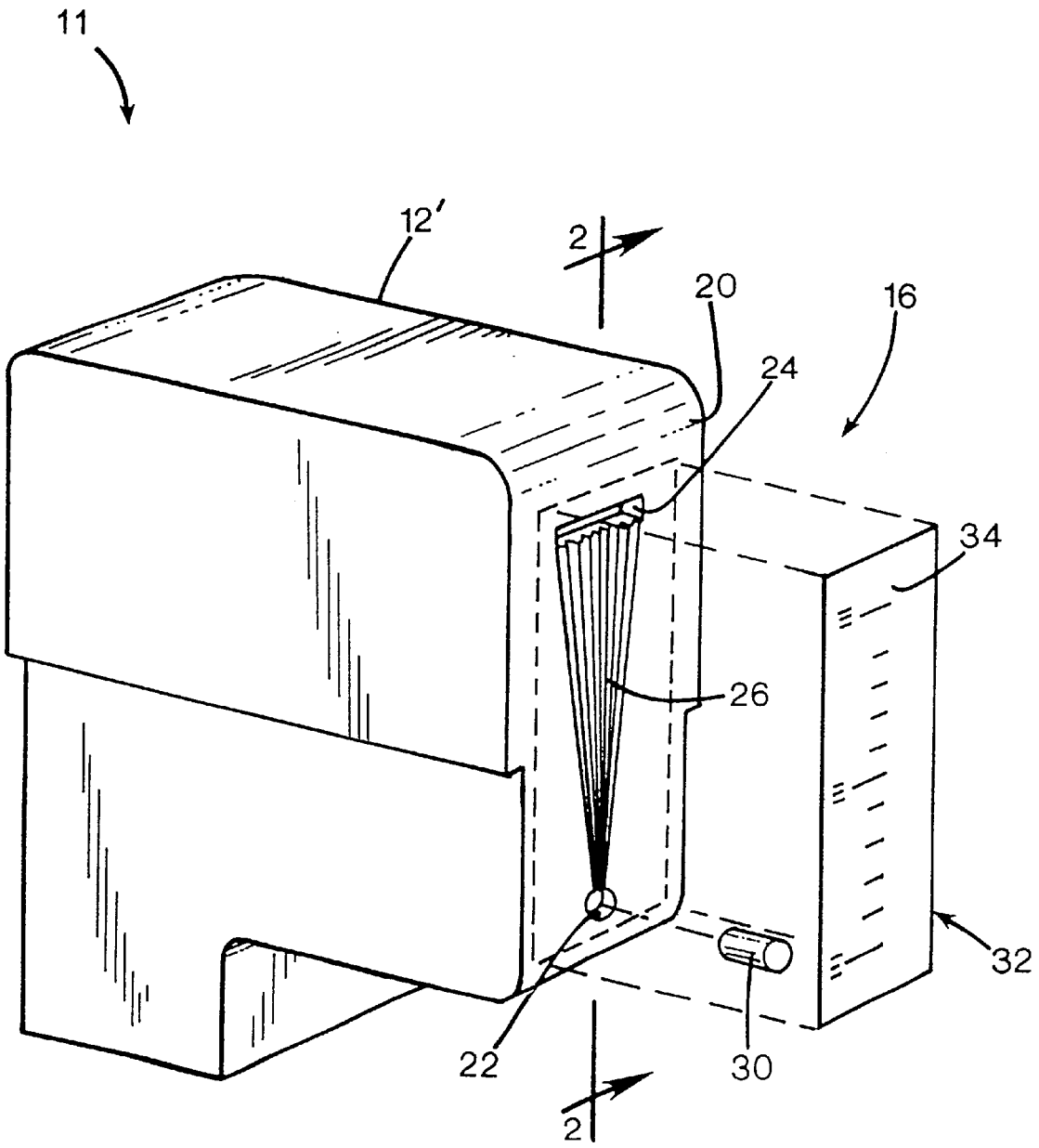
FIG. 1B is an exploded perspective view of an ink jet printer ink container according to an alternative application of the invention.

In an alternative application of the invention, the capillary action manometer 16 is utilized in an ink container 11 as shown in FIG. 1B. Such an ink container includes a housing 12' which is adapted to mate with a receiver (not shown) so that ink contained within the ink container can be supplied to the receiver. A fluid interconnect using conventional technologies is provided in and through the housing 12'. A mating interconnect is to be found in the receiver and the ink supplied to the receiver by the ink container is routed to a printhead mounted on or adjacent the receiver so that ink may be supplied for printing operations.

Figure 2:
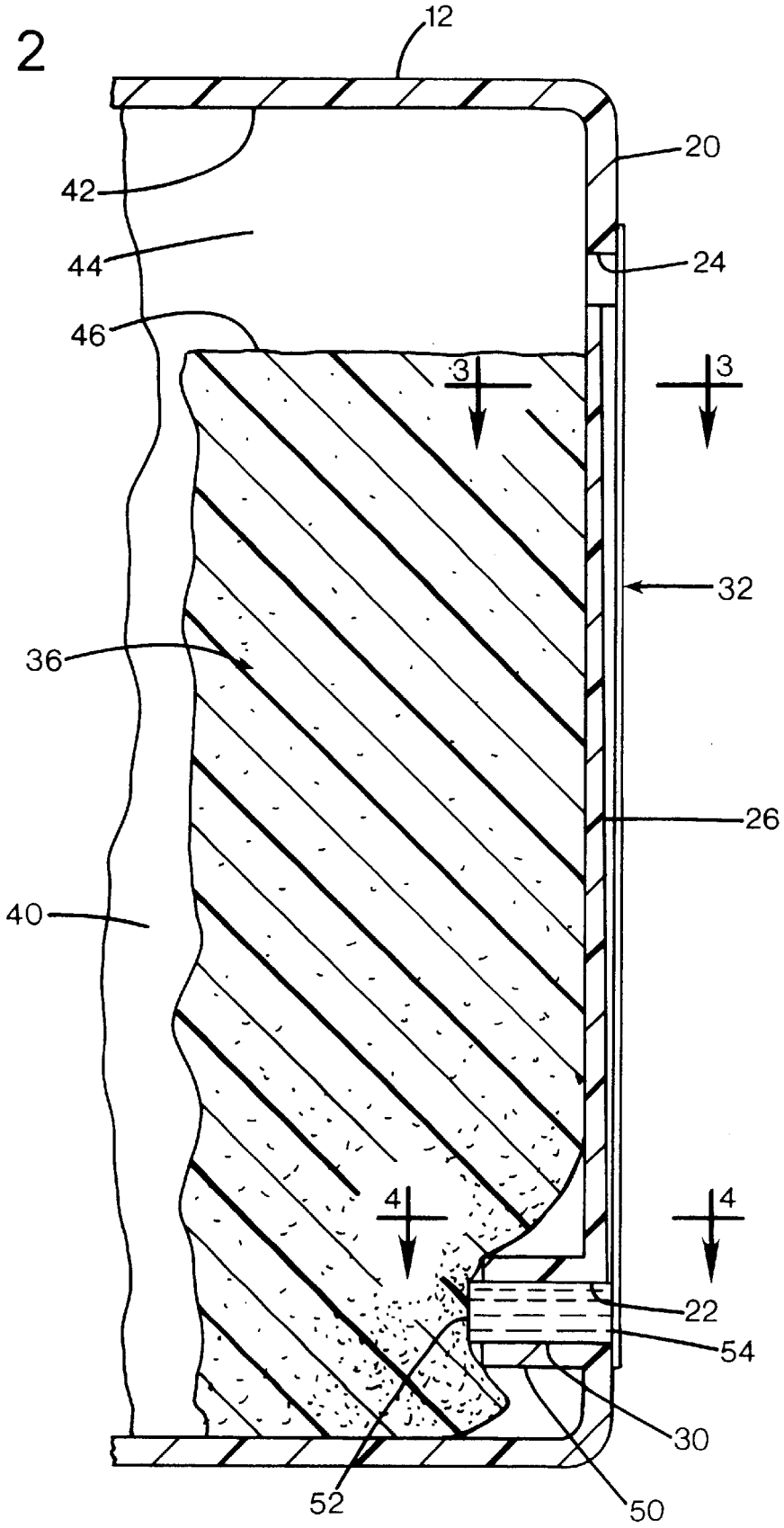
FIG. 2 is an enlarged sectional side view of an ink jet printer pen according to the embodiment of FIG. 1A or 1B taken along line 2—2 of FIG. 1A or 1B.

As shown in FIG. 2, a foam element 36 substantially fills a major ink chamber 40 in the pen or ink container, except that it is spaced apart from the upper wall 42 to allow an air space 44. Although not shown, the air space is provided with a controlled air intake to admit air as needed to prevent atmospheric pressure changes and temperature changes from affecting relative chamber pressure. The upper surface 46 is at a level below the upper passage 24, so that air may freely communicate between the manometer and the ink chamber 40. In a preferred embodiment, the foam element is more highly compressed at the bottom than at the top. This provides a gradient of what will be described as "capillarity" or "capillary affinity".

"Capillarity" is the affinity a given structure or material has for a selected fluid, that is, the tendency and amount by which the structure will draw in the fluid with a negative head against other forces such as gravity or suction. Capillarity is dependent on the nature of the structure's material, the shape of passages formed, the size of the passages, and the surface roughness of the material, among other factors. Capillarity is higher, that is, a greater suction or negative head will be developed, when more wettable materials such as metal or glass are used, as opposed to some plastics, when passages have sharp corners, edges or vertexes, as opposed to round cross sections, when passages are smaller, and when increased surface roughness provides a more wettable surface, as opposed to a less wettable polished surface.

The foam element is "filled" with ink, so that it is retains a substantial volume of ink at just below saturation, to ensure that a slight negative pressure is maintained in the pen to prevent ink drooling out of the print head nozzles. With the capillarity gradient in the foam (the higher capillarity being nearest the bottom of the ink chamber, that is, closest to the print head, and the lower passage 22), ink in the foam tends to be drawn downward from the lower capillarity regions toward the higher capillarity regions near the print head. As ink is removed from the foam element, an increasing negative pressure is developed from which the print head must draw ink. When the negative pressure reaches a certain threshold, the it becomes too great for the print head to draw ink, and the pen or ink container is considered depleted.

However, in the depleted condition, there remains ink throughout the foam. To minimize waste, it is desirable to remove as much of the ink from the foam as possible. With the capillarity gradient in the foam, the bottom portions of the foam draw ink from the upper portions, avoiding unusable pockets of ink concentration. Essentially, the gradient functions analogously to a slanted sink bottom that urges fluid toward a drain outlet to avoid substantial puddling remote from the drain.

The lower passage is defined by a standpipe 50 that extends laterally into the chamber 40. The inner end 52 of the plug 30 extends beyond the end of the standpipe, to ensure that the plug directly and compressively contacts the foam for a continuous capillary connection. The outer end 54 of the plug is flush with the housing surface, so that it directly contacts the adhesive surface of the window 32. This causes the wicking-transmitted ink to wet the window surface, and to communicate upward to the grooves.

Figure 3:
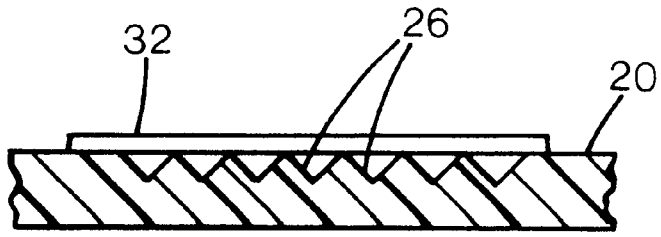
FIG. 3 is an enlarged sectional top view of the article of FIG. 1A or 1B taken along line 3—3 of FIG. 2.
Figure 4:
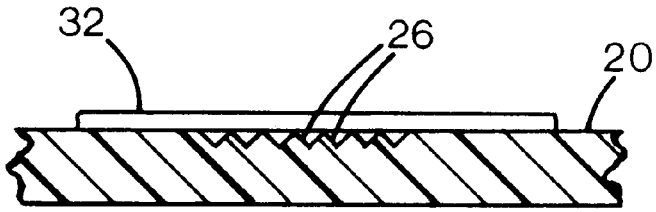
FIG. 4 is an enlarged sectional top view of the article of FIG. 1A or 1B taken along line 4—4 of FIG. 2.

As shown in FIGS. 3 and 4, the grooves 26 are sharply V-shaped, with their peaks extending just to the plane of the surface 20, so that the window film 20 is supported by the peaks. The peaks may be formed with slight flat tops (not shown) to ensure consistent height even with small variations in the plastic molding process used to manufacture the pen. The grooves vary in width and depth over their length. In the preferred embodiment, the foam element generates a negative pressure head of 2 inches (51 mm) when full, and 8 inches (203 mm) when effectively empty. Thus, the groove size should be calculated using well known physics principles or proven with basic experimentation to provide a width near the bottom providing high capillarity capable of generating a head comparable to that of the empty pen, and a width near the top capable of generating a lower head comparable to that of the full pen. The printed indicia on the window preferably includes "full" and "empty" marks at these levels, as well as intermediate marks corresponding to intermediate pen fill conditions.

Figure 5:
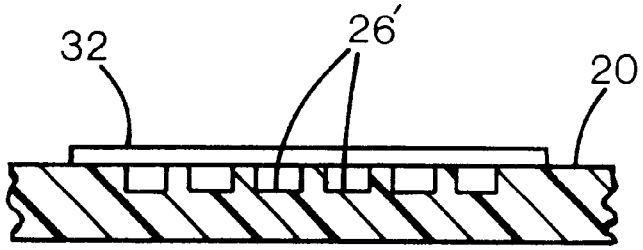
FIG. 5 is an enlarged sectional top view of an article according to a first alternative embodiment of the invention.
Figure 6:
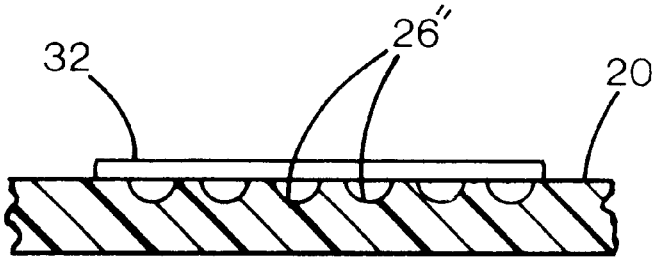
FIG. 6 is an enlarged sectional top view of an article according to a second alternative embodiment of the invention.
Figure 7:
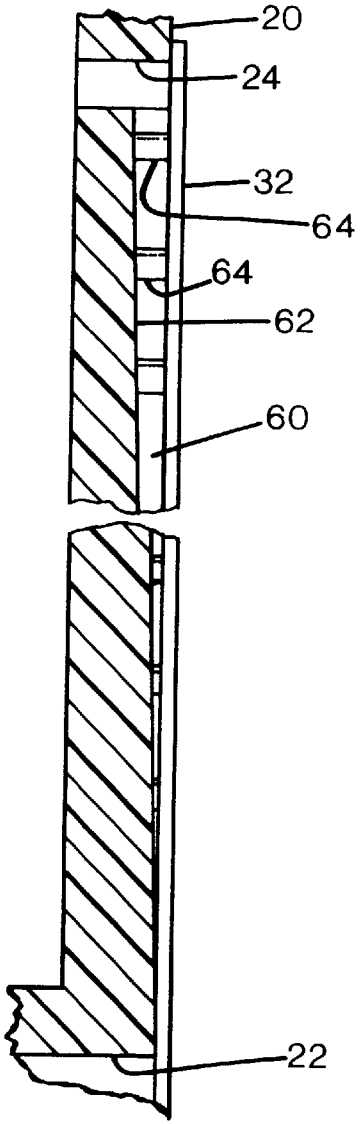
FIG. 7 is an enlarged sectional side view of an article according to a third alternative embodiment of the invention.

It is notable that the gradient in the capillaries may be adjusted by other means, such as by the use of different materials, textures, or shapes. As shown in FIGS. 5 and 6, the grooves may have cross sectional profiles of any shape, such as the rectangular channels 26' of FIG. 5, and the semicircular channels 26" of FIG. 6. A gradient capillarity may also be provided in an ungrooved elongated channel 60, such as shown in FIG. 7. This channel has a wedge shaped cross section defined by a slightly recessed floor 62 that is angled with respect to the housing surface 20, on which window 32 is mounted. The spacing at the extremes adjacent to the passages 22, 24 may be calculated or experimentally determined to provide the desired extremes of capillary, as discussed above. A plurality of small standoffs 64 provide mounting points for adhesion, and spacers for controlling the planarity of the film and width of the gap.

In an alternative embodiment, the capillary grooves may be parallel, with the taper and size gradient eliminated. This would be suitable for embodiments in which a large change in appearance is desired as the ink level drops below a selected threshold. Also, the effect of gravity is believed to provide some gradient effect to make column height a function of fill level.

Figure 8:
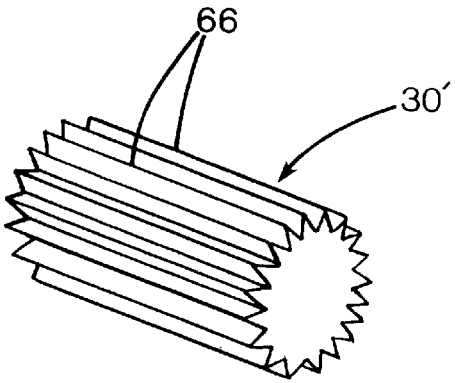
FIG. 8 is a perspective view of an alternative passage plug.

FIG. 8 shows an alternative plug 30' that is molded as a solid non-porous cylindrical element with axial ridges 64 running along the entire length. When press fit into the lower passage 22 in the manner shown in FIG. 2, the valleys between the ridges and surface of the passage define separate channels that serve as capillary conduits between the foam element and the manometer grooves.

While the above is discussed in terms of preferred and alternative embodiments, the invention is not intended to be so limited. For instance, the manometer feature need not have a linear gradient, but may provide more sensitivity at different portions of the range, such as to provide better discernment of ink level as it approaches empty. Non linearity may also be employed when the capillarity of the foam is non linear; to provide the function of linearity, the gradient characteristics of the foam may need to be reflected in the function of the capillary feature.

Another approach to accommodate such nonlinearities is to position the level marks on the window at appropriate positions to correctly indicate "full", "empty", "half", and "quarter" positions, for example, even if these are not evenly spaced. Also, the gradient may be replaced with a stepped feature that indicated discrete ink levels, provided by grooves that are the same width within each step, but differ in characteristics from step to step. In addition, the housing surface beneath the window may be plated to provide a better wicking material or texture, or may be colored white or another reflective color to improve visibility and contrast. Different portions of the surface may be colored differently, such as with a red portion near the lower passage, which is revealed when the ink level is near depletion.

In alternative embodiments, the capillary gauge may be used with ink supplies that do not use capillary foam. Also, the concept may be used where the gauge is read by other means. For instance, an electrical contact in the gauge may indicate to control circuitry when the level has dropped below a threshold. This and other approaches such as thermal sensors would not require a light transmissive window. In addition, a visual gauge need not be read by a human user, but may be read by a sensor on a printer. In such cases, the gauge may best be oriented horizontally so that a fixed single sensor may read the gauge level as it reciprocates on the scan axis.

We claim:

1. An ink container comprising:

a) a body defining an ink chamber;

b) a capillary action manometer having a proximal end and a distal end, the manometer having a capillarity gradient with a maximum capillary affinity near the proximal end and a minimum capillary affinity near the distal end; and c) a fluid passage connecting the ink chamber and the proximal end of the manometer.

2. The ink container of claim 1, wherein the fluid passage connecting the ink chamber and the proximal end of the manometer has a greater capillary affinity than the manometer proximal end.

3. The ink container of claim 1, wherein the capillary action manometer further has an optically translucent wall allowing visual observation of ink within the manometer.

4. The ink container of claim 1, wherein the capillary action manometer further comprises a plurality of manometers each having a proximal end and a distal end.

5. The ink container of claim 4, wherein each of the manometers has a substantially straight central section between the proximal and distal ends.

6. An ink container comprising:

a) an ink chamber;

b) capillary action manometer having a capillarity gradient with a maximum capillary affinity near the proximal end and a minimum capillary affinity near the distal end; and c) fluid passage fluidically connecting the ink chamber to the capillary action manometer.

7. A method of detecting remaining ink in an ink container, the ink container having an ink chamber, comprising;

a) providing a capillary action manometer having a capillarity gradient;

b) providing a fluid connection between the ink chamber and the manometer; and c) observing ink within the manometer.

* * * * *